US010794022B2

(12) United States Patent
Reiner

(10) Patent No.: US 10,794,022 B2
(45) Date of Patent: Oct. 6, 2020

(54) RETRACTABLE BARRIER ASSEMBLY

(71) Applicant: Andrew Eric Reiner, Woodland Hills, CA (US)

(72) Inventor: Andrew Eric Reiner, Woodland Hills, CA (US)

( * ) Notice: Subject to any disclaimer, the term of this patent is extended or adjusted under 35 U.S.C. 154(b) by 96 days.

(21) Appl. No.: 16/131,676

(22) Filed: Sep. 14, 2018

(65) Prior Publication Data

US 2019/0063018 A1 Feb. 28, 2019

Related U.S. Application Data

(63) Continuation-in-part of application No. 15/201,665, filed on Jul. 5, 2016, now Pat. No. 10,100,574.

(51) Int. Cl.

| | |
|---|---|
| ***E06B 9/08*** | (2006.01) |
| ***E01F 13/02*** | (2006.01) |
| ***B65H 75/48*** | (2006.01) |
| ***B65H 75/44*** | (2006.01) |
| *E06B 9/06* | (2006.01) |

(52) U.S. Cl.

CPC ..... *E01F 13/028* (2013.01); *B65H 75/4471* (2013.01); *B65H 75/48* (2013.01); *E01F 13/022* (2013.01); *B65H 2402/63* (2013.01); *E06B 9/0692* (2013.01)

(58) Field of Classification Search

CPC ..... E06B 9/18; E06B 9/0646; E06B 9/0692; E06B 9/08; E06B 2009/002; E06B 11/02; E06B 11/023; E06B 11/026; E01F 13/028; E01F 13/022; B65H 75/4471; B65H 75/48; A47G 5/02

See application file for complete search history.

(56) References Cited

U.S. PATENT DOCUMENTS

| | | | |
|---|---|---|---|
| 193,573 | A | 7/1877 | Tripp |
| 354,450 | A | 12/1886 | Tripp |
| 376,436 | A | 1/1888 | Harrison |
| 535,141 | A | 3/1895 | Logan |
| 746,403 | A | 12/1903 | Tarney |

(Continued)

FOREIGN PATENT DOCUMENTS

| | | | | |
|---|---|---|---|---|
| CA | 2233760 | A1 * | 11/1999 | ..... E01F 13/02 |
| CA | 2233760 | A1 | 11/1999 | |

(Continued)

*Primary Examiner* — Johnnie A. Shablack

(74) *Attorney, Agent, or Firm* — BranchMark, PLC

(57) ABSTRACT

A non-anchored, self-supporting screen assembly for selective placement by a user on a walking surface. The assembly includes a housing having a first end, a second end, and a sidewall extending therebetween and having an elongate opening. A base independently supports and disposes the housing in an upright position substantially normal to the walking surface during use. A rotatable rod is disposed within the housing and coupled to a trailing edge of a flexible screen. The flexible screen may be coupled to an external attachment point upon extension of the screen through the elongate opening and decoupled upon retraction. A spring is coupled to the rotatable rod to exert a force in a direction opposite a direction of extension of the flexible screen. The flexible screen of an adjacent assembly may be coupled to the assembly to form a screen system.

6 Claims, 10 Drawing Sheets

(56) References Cited

U.S. PATENT DOCUMENTS 832,335 A 10/1906 McDonald
1,692,206 A 11/1928 Griffiths
2,583,824 A 1/1952 Dwinell
2,961,255 A 11/1960 Trott
3,220,464 A 11/1965 Wise
3,688,440 A 9/1972 Applegarth et al.
3,839,824 A 10/1974 Ellis et al.
3,880,405 A 4/1975 Brueske
3,917,231 A 11/1975 Fink
4,124,196 A * 11/1978 Hipskind ..... E01F 7/00 116/63 P
4,129,146 A 12/1978 Schuler
4,186,912 A 2/1980 Byrd, Jr.
4,595,155 A * 6/1986 Gough ..... A63B 61/02 242/395.1
4,606,394 A * 8/1986 Bannister ..... E04B 2/7416 16/354
4,844,420 A 7/1989 Oster
5,029,819 A * 7/1991 Kane ..... E01F 13/028 160/24
5,117,859 A 6/1992 Carlson
5,170,829 A 12/1992 Duncan et al.
5,421,530 A 6/1995 Bertagna et al.
5,507,446 A 4/1996 Ditzig
5,636,679 A 6/1997 Miller et al.
5,906,421 A * 5/1999 Floyd ..... E06B 9/02 160/100
6,056,038 A 5/2000 Foster et al.
6,142,701 A * 11/2000 Falcon ..... E01F 13/028 160/24
6,338,450 B1 1/2002 Schwendinger
6,375,164 B1 * 4/2002 Siegler ..... E01F 13/028 256/1
6,375,165 B1 * 4/2002 Sherratt ..... E06B 9/0692 256/1
6,435,250 B1 8/2002 Pichik et al.
6,536,502 B2 * 3/2003 Britto ..... E06B 9/08 160/23.1
6,575,435 B1 6/2003 Kotzen
6,688,480 B1 2/2004 Denny
6,807,999 B1 10/2004 Bowen et al.
6,814,127 B2 11/2004 Tagtow et al.
7,207,370 B2 4/2007 Snyder et al.
7,217,061 B2 * 5/2007 Stratton ..... E01F 7/00 160/24
7,219,709 B1 5/2007 Williams
7,237,591 B2 7/2007 Snyder et al.
7,337,822 B2 3/2008 Snyder et al.
7,384,017 B1 6/2008 Burke et al.
7,438,112 B2 10/2008 Cheng
7,472,739 B2 1/2009 Heidenreich
7,503,374 B2 3/2009 Takeuchi et al.
7,581,775 B2 9/2009 Lekar
7,971,622 B2 * 7/2011 Trionfetti ..... E04B 2/7416 160/122
8,087,443 B2 1/2012 Snyder et al.
8,118,250 B1 * 2/2012 Helseth ..... B65H 75/425 242/379
8,191,604 B2 * 6/2012 Wang ..... E06B 9/0692 160/23.1
8,490,668 B2 7/2013 Snyder et al.
8,881,787 B2 * 11/2014 Wang ..... E06B 9/60 160/24
8,887,441 B2 * 11/2014 Lundh ..... E05B 43/00 49/55
8,991,470 B1 3/2015 Pacheco
9,290,990 B2 3/2016 Hicks et al.
9,351,599 B2 5/2016 Roberts
9,433,308 B1 * 9/2016 Kalinski ..... E06B 9/40
9,598,896 B1 * 3/2017 Pichik ..... E06B 9/08
9,714,491 B2 * 7/2017 Wettern ..... E01F 13/022
9,717,974 B2 * 8/2017 Hahn ..... A63B 71/023
9,719,272 B1 * 8/2017 Torsiello, Jr. ..... E01F 13/024
10,053,888 B2 * 8/2018 Mitchell ..... B65H 75/38
10,094,166 B2 * 10/2018 Reiner ..... E06B 9/60
10,100,574 B2 * 10/2018 Reiner ..... E06B 9/18
10,184,261 B2 * 1/2019 Torsiello ..... E01F 13/024
10,249,118 B2 * 4/2019 Heisler, Jr. ..... E04G 21/3233
2003/0111657 A1 * 6/2003 Green ..... A47F 10/00 256/45
2003/0164485 A1 * 9/2003 Olson ..... B21F 33/002 256/37
2005/0098770 A1 5/2005 Schell
2005/0211389 A1 9/2005 Snyder et al.
2006/0076544 A1 4/2006 Kurple
2006/0113519 A1 6/2006 Prismall
2006/0131551 A1 * 6/2006 Hopp ..... E01F 13/028 256/21
2006/0151123 A1 7/2006 Chandler et al.
2006/0191644 A1 8/2006 Snyder et al.
2006/0213626 A1 9/2006 Snyder et al.
2007/0119998 A1 * 5/2007 Mechling ..... B65H 75/48 242/371
2007/0176158 A1 * 8/2007 Robinson ..... E01F 13/028 256/12.5
2007/0193705 A1 * 8/2007 Hsu ..... A47G 5/02 160/238
2008/0121352 A1 * 5/2008 Cheng ..... E01F 13/028 160/238
2009/0008042 A1 1/2009 Snyder et al.
2010/0301296 A1 * 12/2010 Ratzenberger ..... E01F 13/028 256/24
2012/0256149 A1 * 10/2012 Sylvester ..... E01F 13/028 256/73
2013/0221301 A1 * 8/2013 Cowie ..... E04H 4/06 256/24
2014/0060757 A1 3/2014 Thompson et al.
2015/0190001 A1 7/2015 Floersch et al.
2016/0326705 A1 * 11/2016 Torsiello ..... E01F 13/024
2017/0284154 A1 * 10/2017 Reiner ..... E06B 9/18
2018/0044868 A1 * 2/2018 Miller ..... E01F 13/028
2019/0011081 A1 * 1/2019 Kalinski ..... E01F 13/02
2019/0063018 A1 * 2/2019 Reiner ..... B65H 75/4471
2019/0128007 A1 * 5/2019 Torsiello ..... E01F 13/024

FOREIGN PATENT DOCUMENTS

EP 1106751 A1 * 6/2001 ..... E04H 17/00
EP 1184514 A2 * 3/2002 ..... E01F 13/028
FR 2907491 A1 * 4/2008 ..... E06B 9/08
GB 2395219 A * 5/2004 ..... E01F 7/00
WO WO-9713049 A1 * 4/1997 ..... E01F 13/028
WO WO9713049 A1 4/1997

* cited by examiner

RETRACTABLE BARRIER ASSEMBLY

CROSS-REFERENCE TO RELATED APPLICATIONS

This application is a continuation-in-part of application Ser. No. 15/201,665 filed Jul. 5, 2016, the specification of which is incorporated herein by reference in its entirety.

TECHNICAL FIELD

This invention relates generally to portable, retractable, and interconnectable, gates and partitions for defining pathways in private and public spaces both indoors and outdoors, guiding and routing persons through such pathways, and inhibiting undesired ingress to and egress from such pathways.

BACKGROUND ART

Removable gates, particularly child and pet safety gates, are well known in the art for use in preventing access to residential areas considered unsafe or undesirable for children or pets. Conventional gates characteristically comprise a plurality of cooperating gate sections that are generally horizontally extensible and retractable within specific selected narrow entryways such as between doorjambs, opposed walls, and balustrade uprights, and the like. These safety gates are commonly provided on ends thereof with compressible buffer stops comprising elastomeric material or other suitable spring mechanisms, which when compressed and then released, function to effectively set the corresponding gate or gate sections against displacement between the respective opposed fixed extremes defined by the entryways. Additional safety latches and the like have been used to further secure the relative positions of the corresponding gate sections and prevent inadvertent or undesired disengagement of the same following installation.

To remove the aforementioned safety gates after installation, the safety laches, if any, must first be disabled or released whereupon the buffer stops may be compressed (generally by applying lateral pressure to the same) to temporarily relieve applied tension on the opposed fixed extremes of the corresponding entryways. The gate sections may then be sufficiently retracted for the gate or gate system to be removed. Removable child and pet safety gates of the type described above are commonly used in residential environments solely to prevent access to specific living or working areas such as kitchens, stairways, garages, and the like. Such child and safety gates are not designed or intended to be interconnected to define corresponding pathways, let alone to guide or route children or pets there through, or inhibit undesired ingress to or egress from such defined pathways.

Removable gates have similarly been used in retail and warehouse environments to temporarily prevent access to selected service and work areas such as shopping aisles, check-out aisles and the like, as may be defined, for example, by shelving and storage racks such as pallet rack systems and assemblies. As those skilled in the art will recognize, conventional pallet rack systems typically comprise a plurality of support posts for receiving corresponding horizontal connecting lengths and vertically spaced horizontal rack beams. Each support post generally comprises a single piece of metal having an outwardly faced or facing post section or margin, parallel side post sections or margins, and an opposed terminal end section or margin defining a substantially square or rectangular post cross section. The outwardly facing post sections and parallel post sections are each typically provided with multiple rows of vertically spaced pairs of keyhole slots or other suitable stamped apertures. The slots in each pair are often angularly related to one another to allow a better fit for components being attached to the pallet rack, including the above referenced rack beams. Such pallet rack storage systems are well known to those skilled in the art and are referenced and described in substantial detail in co-pending patent application Serial Nos. 15/083,757, 15/201,665, and 15/380,332 filed Mar. 29, 2016, Jul. 5, 2016, and Dec. 15, 2016, respectively. These applications are all commonly owned by the assignee of the present invention and their disclosures are incorporated herein by reference in their entirety. See also Canadian Patent No. CA2233760 issued to Secure-Plast, Inc.; U.S. Pat. No. 5,170,829 issued to Duncan et al.; U.S. Pat. No. 5,636,679 issued to Miller et al.; U.S. Pat. No. 6,056,038 issued to Foster et al.; U.S. Pat. No. 6,435,250 issued to Pichik et al.; U.S. Pat. No. 6,575,435 issued to Tracy A. Kotzen; U.S. Pat. No. 6,688,480 issued to David S. Denny; U.S. Pat. No. 6,807,999 issued to Bowen et al.; U.S. Pat. No. 7,207,370 issued to Snyder et al.; U.S. Pat. No. 7,219,709 issued to John Williams; U.S. Pat. No. 7,237,591 issued to Snyder et al.; U.S. Pat. No. 7,337,822 issued to Snyder et al.; U.S. Pat. No. 7,384,017 issued to Burke et al.; U.S. Pat. No. 8,087,443 issued to Snyder et al.; U.S. Pat. No. 8,490,668 issued to Snyder et al.; U.S. Pat. No. 8,991,470 issued to Steven A. Pacheco; U.S. Patent Publication No. 2015190001 filed by Floersch et al.; U.S. Patent Publication No. 20050098770 filed by Ronald Allan Schell; U.S. Patent Publication No. 20050211389 filed by Snyder et al et al.; U.S. Patent Publication No. 20060076544 filed by William M. Kurple; U.S. Patent Publication No. 20060113519 filed by Ian James Prismall; U.S. Patent Publication No. 20060151123 filed by Chandler et al.; U.S. Patent Publication No. 20060191644 filed by Snyder et al.; U.S. Patent Publication No. 20060213626 filed by Snyder et al.; U.S. Patent Publication No. 20090008042 filed by Snyder et al.; and International Patent Application WO9713049 filed by Edwin Hardy. Like the child safety and pet gates above, these removable gates, including retractable pallet storage system gates, are not designed to be interconnected to define corresponding pathways, to guide or route persons through such pathways, or to inhibit unauthorized or undesirable ingress to or from such pathways.

Extendable partitions have been used in public private and waiting areas and queues such as transportation centers (airports, train stations, bus stations, etc.), event centers (theatres, concerts, etc.), ticket offices, and the like, for specific traffic control purposes. A typical such extendable partition generally comprises a small top cap affixed or affixable to an upright stanchion supported by a weighted base and having an extensible and retractable belt or "tape". See, for example, U.S. Pat. No. 6,338,450 issued to Schwendinger; U.S. Pat. No. 5,507,446 issued to Ditzig; U.S. Pat. No. 5,421,530 issued to Bertagna; U.S. Pat. No. 5,117,859 issued to Carlson; U.S. Pat. No. 4,844,420 issued to Oster; U.S. Pat. No. 4,186,912 issued to Byre, Jr.; U.S. Pat. No. 4,124,196 issued to Hipskind; U.S. Pat. No. 3,917,231 issued to Find; U.S. Pat. Nos. 3,839,824; 3,880,405 issued to Brueske; U.S. Pat. No. 3,220,464 issued to Wise; U.S. Pat. No. 3,688,440 issued to Appelgarth et al.; U.S. Pat. Nos. 2,961,255; 535,141; 376,436 issued to Harrison, U.S. Pat. Nos. 354,450, and 193,573. While these extendible partitions may be suitable for the particular purposes to which they address, they would not be suitable for the purpose of the present invention as heretofore described. Namely, as indicated above, these tape type stanchions are directed principally to generally guiding and routing persons along designated pathways, but do not prohibit ingress to such pathways or egress therefrom, as persons can readily and easily climb over or duck under the corresponding belts to move in and out of the designated pathways. Moreover, these prior art tapes are of insufficient width to permit any meaningful pre-printed signage thereon including one or more advertising or public or private messages that may be readily noticed and viewed by persons, whether traveling along the corresponding pathway or otherwise.

Still further, the mechanical designs of the referenced prior art cap and tape type stanchions are insufficient to permit retrofitting the same with wider belts as their mechanical designs fail to address winding issues known to occur in larger retractable gates wherein typical tacky or "rubber" materials or textures become bound or "bunched up" during extension and/or retraction creating barriers to both operation and installation.

Accordingly, there is a need for an improved retractable barrier assembly for guiding and routing persons along designated pathways defined by interconnecting multiple such assemblies and which assembly further functions to inhibit unauthorized or undesired ingress to and egress from such pathways. Such assembly must further be mechanically suited to permit pre-printed signage including advertising or other public or private messages on corresponding extensible and retractable gates and which gates may be readily operated for their intended purpose while overcoming the aforementioned prior art functional issues of "bunching up" upon extension or retraction thereof. Finally, such improved retractable barrier assembly should be affixed or affixable to a retaining member such as a base or other securable or weighted structure to define a primary stanchion that is portable and may be quickly and easily installed and removed and engaged and disengaged with other assemblies and corresponding secondary stanchions.

DISCLOSURE OF INVENTION

It is a principle object of the present invention to provide an improved portable and retractable barrier assembly for guiding and routing persons along designated pathways defined by interconnecting multiple such assemblies placed indoors or outdoors, which assembly further functions to inhibit unauthorized or undesired ingress to and egress from such pathways, which assembly is mechanically suited to permit pre-printed signage including advertising or other public or private messages on corresponding extensible and retractable gates, and which assembly may further be quickly and easily installed and removed and engaged and disengaged with additional such assemblies.

It is a further object of the present invention to provide such an improved portable and retractable barrier assembly, which assembly is aesthetically pleasing and comprises a flexible screen that may be readily extended and retracted without bunching up upon such extension and/or retraction.

It is still further an object of the present invention to provide an improved portable and retractable barrier assembly for guiding and routing persons along designated pathways defined by interconnecting multiple such assemblies placed indoors or outdoors, comprising a winding mechanism coupled to a rotatable rod for applying rotational tension on the rod, which winding mechanism comprises a spring mechanism including but not limited to a torsion spring, and a guide member having a surface of sufficient diameter oriented substantially perpendicular to a flexible gate or screen to guide and inhibit binding of the screen upon retractably receiving the same.

It is still further an object of the present invention to provide such an improved portable and retractable barrier assembly wherein the flexible gate or screen is comprised of material or materials having a modulus of elasticity sufficiently high such that the foregoing has sufficient stiffness to inhibit binding or "bunching up" during extension and/or retraction thereof.

Yet still further, it is an object of the present invention to provide such an improved portable and retractable barrier assembly, wherein the flexible gate or screen comprises one or more support members such as plastic, metal, wire, material, or the like, which support members may be coupled thereto to provide sufficient stiffness thus promoting the smooth retraction thereof by inhibiting or obviating binding or bunching up of the gate which might otherwise result during retraction.

In carrying out these and other objects, features and advantages of the present invention, there is provided an improved portable and retractable barrier assembly generally comprising a retaining member such as, but not limited to, a weighted base, and a removable housing. The housing comprises a first end removably affixable to the base, and a second opposing end defining a primary upright stanchion between the opposing housing ends. The housing further comprises a sidewall extending between the first and second housing ends and includes an elongate opening disposed therein through which a flexible gate or screen may be readily extended and retracted without bunching up. A rotatable rod is disposed within the housing and coupled thereto. The aforementioned flexible screen includes a leading edge, a trailing edge, and a top edge extending between the leading edge and trailing edge, wherein the trailing edge is coupled to the rotatable rod, and the leading edge further includes an edge attachment mechanism, such as, but not limited to, one or more removably affixable brackets, for selectively and readily coupling and decoupling with a secondary upright stanchion to define a designated pathway to control and route persons there through. Finally, the assembly includes a winding mechanism coupled to the rotatable rod for retractably receiving and extending the flexible screen through the elongate opening of the sidewall as referenced above. In one preferred, but not required embodiment, the winding mechanism further comprises a substantially rigid guide member having a surface of sufficient diameter oriented substantially perpendicular to the flexible screen to guide the flexible screen upon retractably receiving the screen. Still further, in one preferred, but not required embodiment, the flexible screen is comprised of material having a modulus of elasticity to provide the screen with sufficient stiffness to inhibit binding or bunching up of the screen upon the retractably receiving the screen on the rotatable rod. Finally, in an additional preferred, but not required embodiment, the flexible gate or screen may be tapered (for example having a greater height at a leading edge than the corresponding trailing edge) to further assist in inhibiting or obviating the above referenced binding or bunching up of the screen during extension and/or retraction thereof.

The improved retractable barrier assembly shown and described herein may be affixed or removable affixable to a base or other securable retaining member in any suitable manner. As further shown and described herein, in one preferred, but not required embodiment, an upright socket is affixed or affixable to such retaining member, again such as a weighted base, or may alternatively be integrally formed therewith. The socket functions to removably receive and secure the housing. In an additional preferred, but not required embodiment, the housing may be affixed to the retaining member through an angle bracket or other suitable permanent or removable fastening means.

BEST MODES FOR CARRYING OUT THE INVENTION

Figure 1:
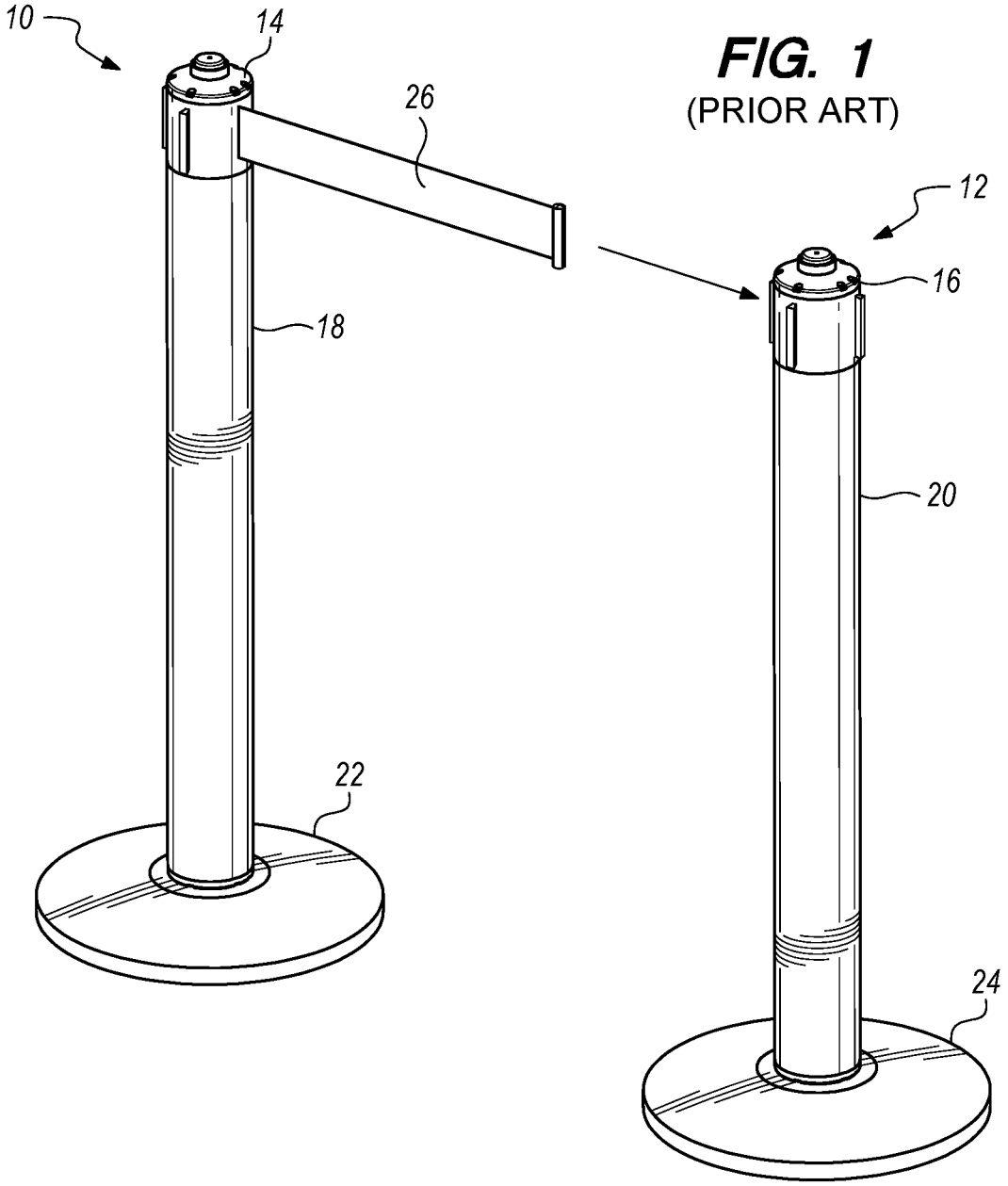
FIG. 1 (PRIOR ART)
FIG. 1 is a perspective diagram of a prior art cap and tape style retractable partition shown partially extended to be affixable to a secondary such partition.
Figure 2:
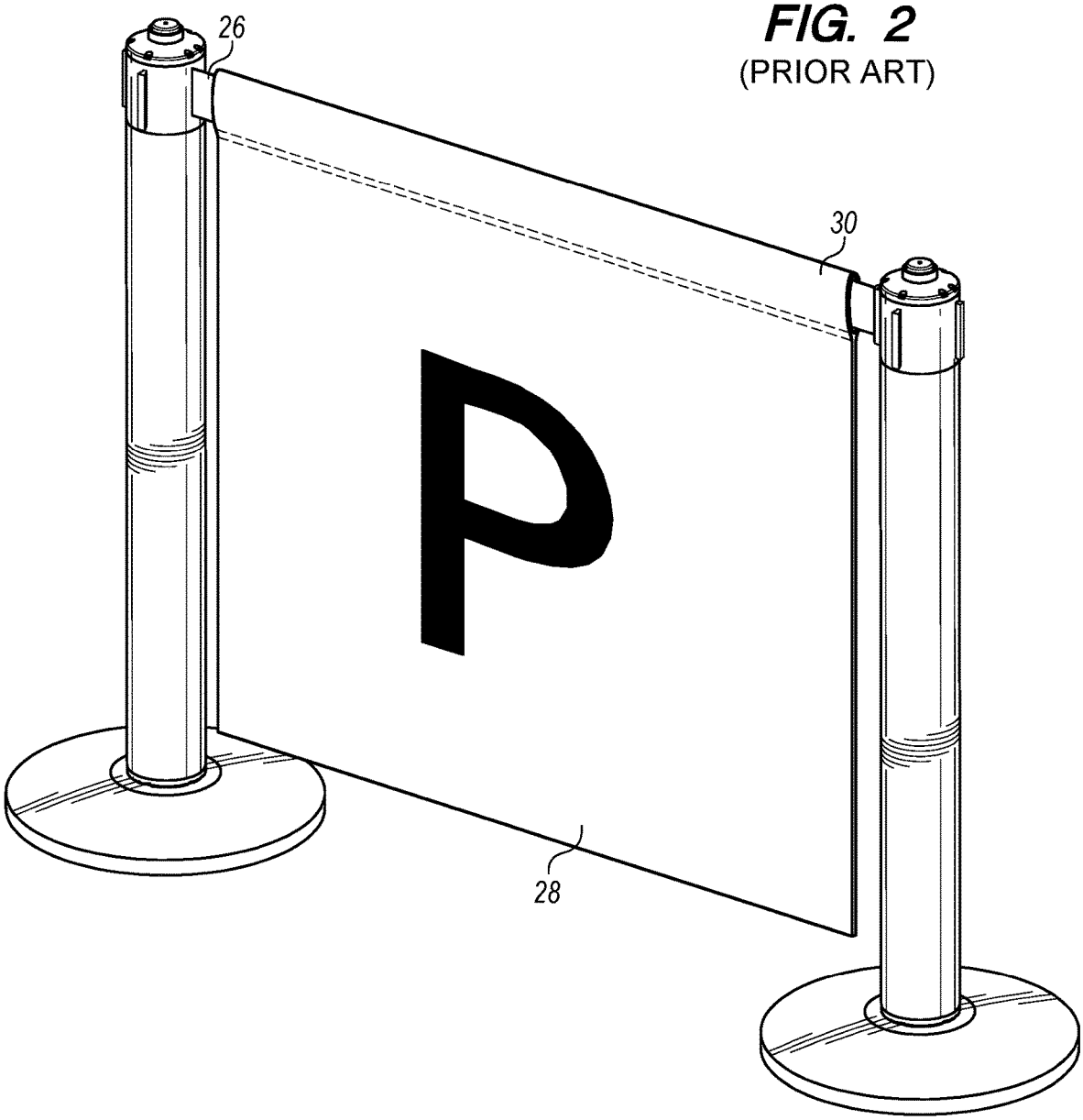
FIG. 2 (PRIOR ART)
FIG. 2 is a perspective diagram of the prior art cap and tape style retractable partition of FIG. 1 shown with its tape member threaded through a supplemental signage member to retain and display the same.
Figure 3A:
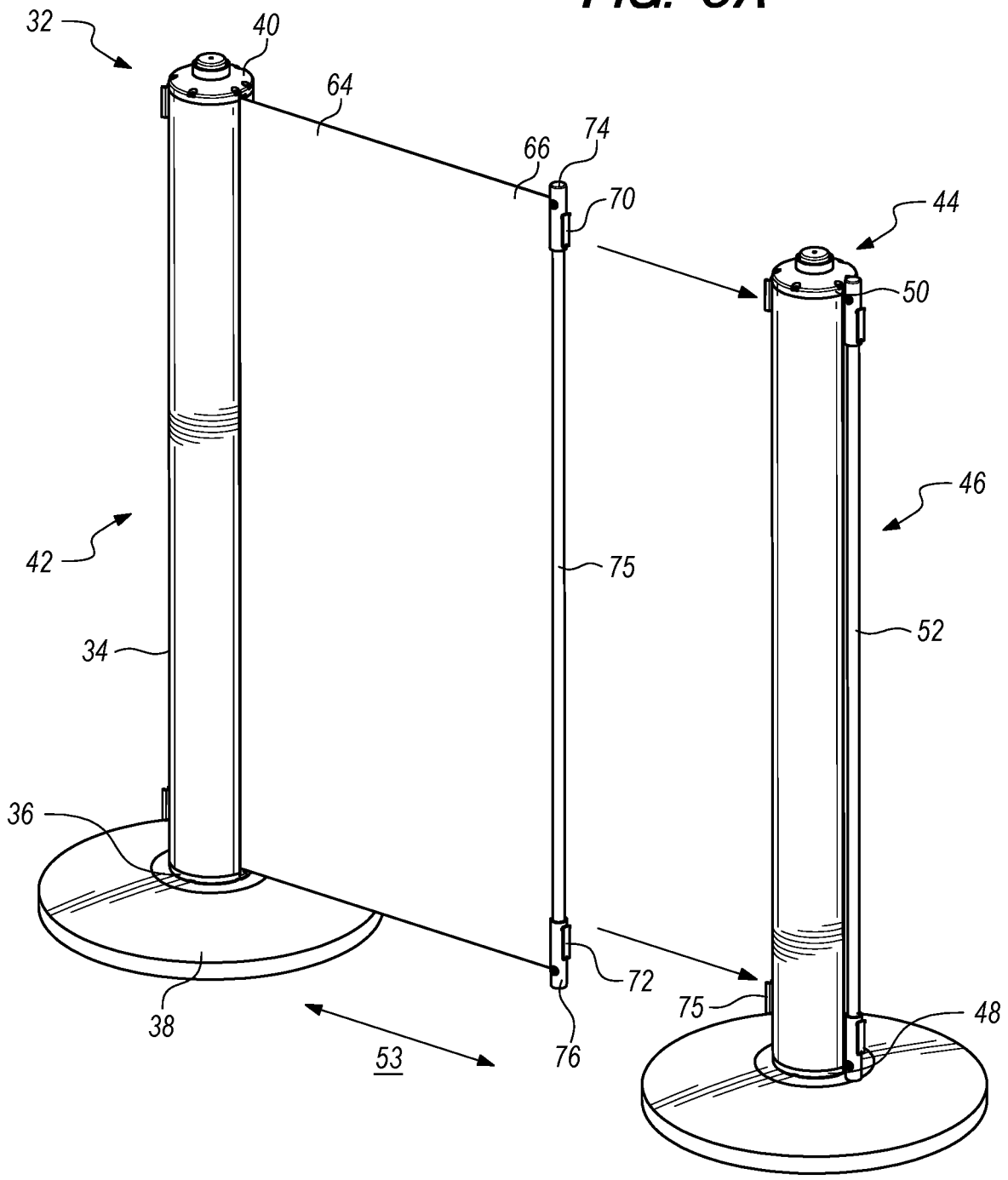
FIG. 3A is a perspective diagram of the improved retractable gate assembly of the present invention for guiding and routing persons along designated pathways defined by interconnecting the retractable gate assembly with one or more additional such assemblies, and inhibiting ingress to and egress from such pathways, shown with its retractable screen partially extended for connection to an additional such assembly.
Figure 3B:
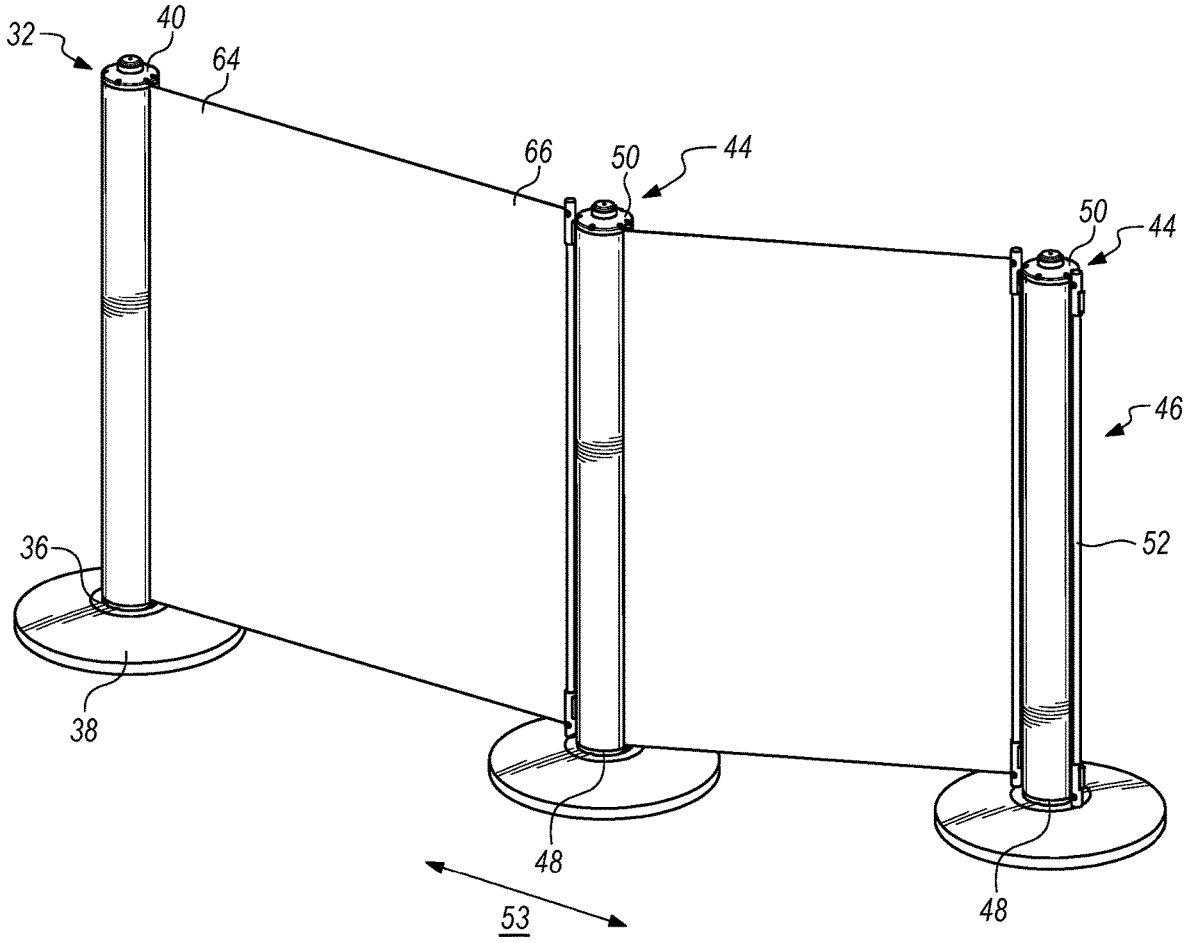
FIG. 3B is a perspective diagram of the improved retractable gate assembly of the present invention for guiding and routing persons along designated pathways defined by interconnecting the retractable gate assembly with one or more additional such assemblies, and inhibiting undesired or unauthorized ingress to and egress from such pathways, shown with the respective retractable screens fully extended.
Figure 4:
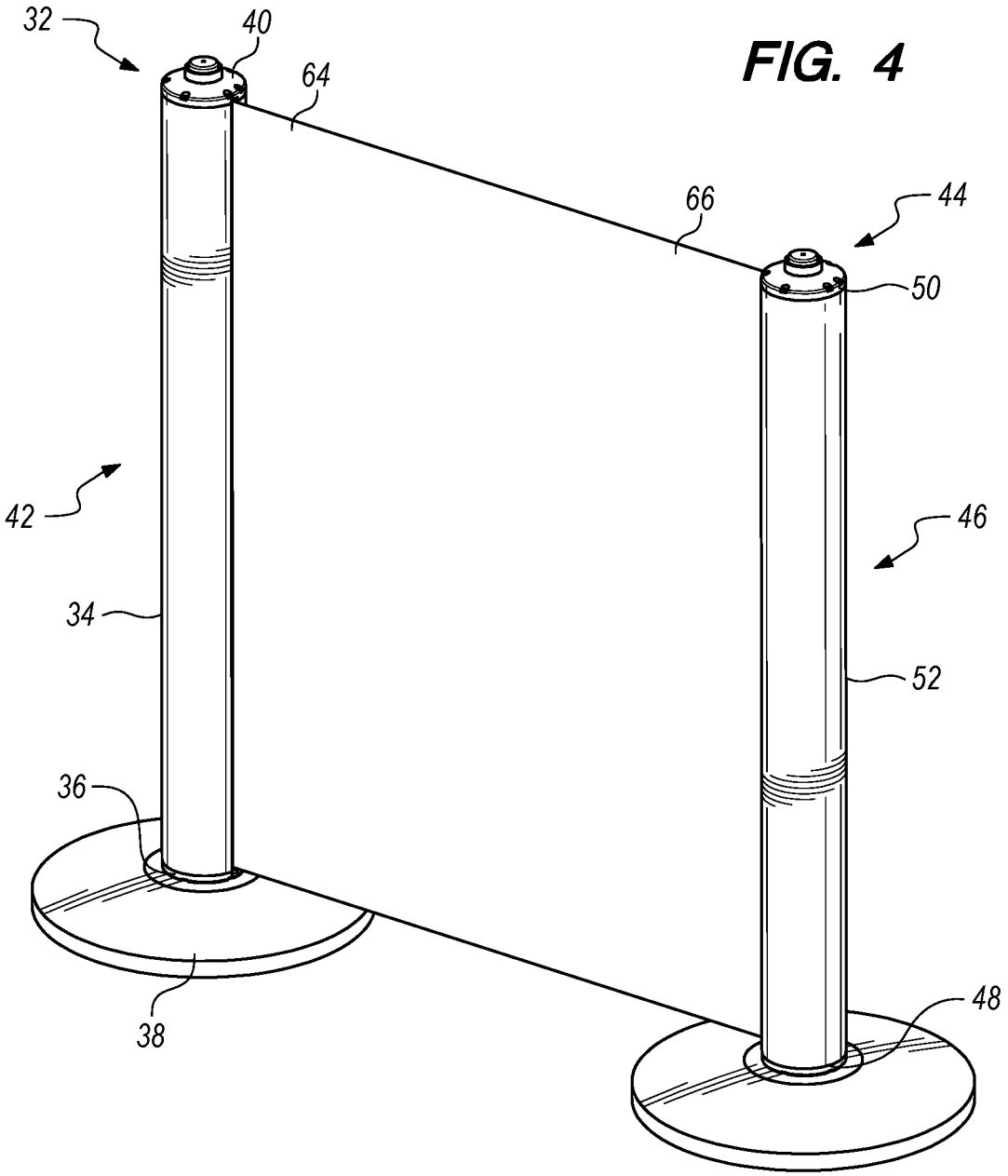
FIG. 4 is a perspective diagram of the improved retractable gate assembly of the present invention for guiding and routing persons along designated pathways defined by interconnecting the retractable gate assembly with one or more additional such assemblies, and inhibiting ingress to and egress from such pathways, shown with its retractable screen full extended and connected to an additional such assembly.

With reference to FIG. 1 of the drawings, there is provided a perspective diagram of a plurality of prior art interconnectable cap and tape style retractable partitions designated generally by reference numerals 10 and 12, respectively. Partitions 10 and 12 each include respective top caps 14 and 16 affixed or affixable to corresponding upright stanchions 18 and 20, which stanchions are further affixed to corresponding retaining members, in each case shown as weighted bases 22 and 24, respectively. Top cap 14 and 16 each include or incorporate a corresponding retractable tape member that may be removably affixed to a corresponding secondary prior art cap and tape style retractable partition. In FIG. 1, the retractable tape of partition 10 is designated generally by reference numeral 26 and is shown partially extended for connection to secondary retractable partition 12, and more particularly to top cap 16 of secondary retractable partition 12. As those skilled in the art will recognize, prior art retractable partitions of the type shown in FIG. 1, are typically used principally for crowd control, namely for guiding and routing persons along designated pathways defined by the interconnected partitions, and more particularly pathways defined by the corresponding extended tape members 26, but without substantially inhibiting ingress to or egress from such pathways as persons may readily climb over or duck under the extensible tapes 26. As referenced above, the retractable element of the prior art partitions, here tape 26, is also of insufficient width to permit any substantial or readily noticeable pre-printed signage thereon including advertising or private or public messages. To accommodate such advertising and messaging in prior art retractable barrier assemblies of the type described above, users have heretofore typically utilized supplemental signage members that may be independently affixed to or retained by the retractable tapes. As shown in FIG. 2, for example, an advertising sheet 28 (shown with signage "P") may be conventionally secured to and retained by tape 26 by threading tape 26 through a suitable receiving sleeve 30 or like component of sheet 28.

Turning now to FIGS. 3-10, there will be shown and described the improved retractable barrier assembly 32 of the present invention. Assembly 32 comprises a housing 34 having a bottom end 36 affixable, and preferably, but not necessarily removably affixable, to a retaining member such as, but not limited to, a weighted base member 38, and a top opposing end 40 defining a substantially upright primary stanchion 42 there between. In keeping with the invention, assembly 32 is intended to be interconnected with one or more additional retractable barrier assemblies 44, and more particularly, to be interconnected to substantially corresponding upright secondary stanchions 46 defined by opposing ends 48 and 50 of the housings 52 thereof to define corresponding pathways 53 there between for controlling traffic by guiding and routing traffic therethrough. In further keeping with the invention, the disclosed and claimed retractable barrier assemblies herein function to inhibit ingress to and egress from such defined pathways.

As further shown in FIGS. 3-10, housing 34 includes at least a rotatable elongate mounting rod 54 that may be directly or indirectly affixed to a trailing edge 56 of a flexible gate or screen 58. Mounting rod 54 may comprise any suitable material including, but not limited to, extruded aluminum. The referenced trailing edge 56 of flexible screen 58 may be affixed to mounting rod 54 in any suitable manner. In the preferred but not required embodiment shown, mounting rod 54 is provided with an elongate annular notch 60 that spans a sufficient vertical length of mounting rod 54 such that a concave portion 62 thereof may receive an optional mounting tube 64 affixed to the trailing edge 56 of flexible screen 58. Mounting tube 64 similarly spans a sufficient vertical length of flexible screen 58 and may be affixed thereto by any suitable means including adhesive. As shown, mounting tube 64 may be inserted into the concave notch portion 62 of mounting rod 54 to secure flexible screen 58 to mounting rod 54. Screen 58 may thereafter be wound about mounting rod 54 as will be discussed in further detail below. Again, mounting tube 64 may comprise any suitable material and may be affixed to the trailing edge 56 of flexible screen 58 in any suitable manner including, but not limited to, mechanical attachment, adhesive, or melting/fusing the components together. In the latter case, mounting tube 64 may be comprised of plastic or other material capable of being adhered to flexible screen 58 by applying heat and/or pressure, or the like.

Flexible screen 58 may similarly comprise or include any suitable material or fiber including cloth, canvas, plastic, wire, paper, netting, and the like, or any combination thereof that may be readily and easily retracted about mounting rod 54 when the flexible screen 58 is disengaged, and extended therefrom when the screen 58 is intended to be engaged as necessary to span or define an entryway, queue, or other designated private or public area whether indoors or outdoors, including as referenced above, to be interconnected to a secondary retractable barrier assembly to define a pathway 53 there between. Flexible screen 58, by nature of its unitary, flexible, and retractable design and size, is also amenable to having pre-printed wording or signage placed thereon including of any suitable nature and provided for display at a plurality of extension or recoil positions depending on the placement distance from a secondary retractable assembly or other retention member. For example, such wording or signage may be placed at or near a leading edge 66 of flexible screen 58 for intended display when screen 58 is partially extended, at or near trailing end 56 for intended display when screen 58 is fully extended, or anywhere there between, depending on the positioning of the corresponding assemblies. Such wording or signage may also be printed on opposing sides of the screen 58 and positioned thereon at any suitable location to prevent ink seepage or message interference, depending on the translucency and type of barrier material being used.

Referring more specifically to FIGS. 7-10, in this exemplary application, flexible screen 58 is further provided with an attachment mechanism 68 operative to couple a leading edge 66 thereof to a secondary retractable barrier assembly 44, and more particularly to a secondary stanchion 46. Attachment mechanism 68 may comprise one or more removably inter-lockable bracket members 70 and 72, respectively, that may be affixed at top and/or bottom ends 74 and 76 of the leading edge 66 of screen 58 for receipt by bracket members 73 and 75 placed at corresponding top and bottom ends 50 and 48 of housing 52 of secondary retractable barrier assembly 44, or any other suitable positions there between. For example, bracket 70 may be affixed near the center or midpoint between the respective top and bottom ends 74 and 76 of leading edge 66 of screen 58 (and correspondingly bracket 72 may be affixed near the center or midpoint between the respective top and bottom ends 48 and 50 of housing 52 of secondary retractable barrier assembly 44) to provide quicker and easier connection and disconnection by a user. As shown, brackets 70 may also be affixed to an attachment rod or pull member 78. Pull member 78 may further be affixed to leading edge 66 of flexible screen 58 by any suitable means, including adhesive. It is understood, however, that pull member 78 is provided in a preferred embodiment only and may be eliminated or modified without departing from the spirit or scope of the invention herein described.

Figure 5:
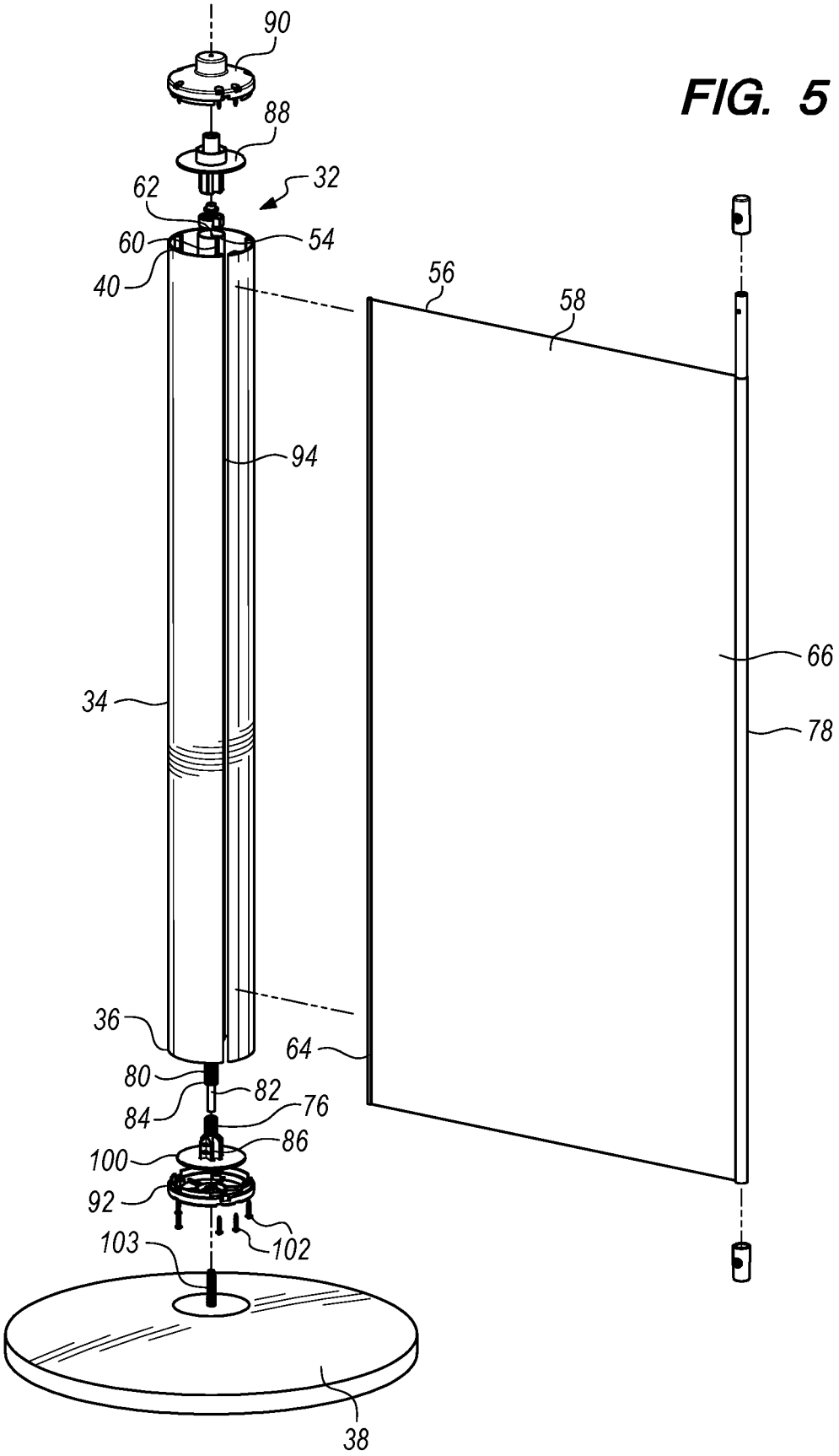
FIG. 5 is an exploded perspective diagram of exemplary components of a preferred, but not required, embodiment of the retractable barrier assembly of the present invention.

A winding mechanism such as a conventional spring or, more preferably, but not necessarily, a torsion spring 80, is further provided as shown in FIG. 5. As those skilled in the art will recognize, torsion springs are typically helical springs that function to exert a torque or rotary force. When twisted, a torsion spring thus exerts a force, actually torque, in the opposite direction that is proportional to the amount (angle) it is twisted. Characteristically, the respective ends of a torsion spring are attached to other components, and when those components rotate around the center of the spring, the spring exerts a counter-force in attempt to push the components back to their original position. While the name implies otherwise, so-called torsion springs are actually subjected to bending stress rather than torsional stress. In operation, such springs function to store and subsequently release substantial angular energy (mechanical energy) or statically hold a mechanism in place by deflecting the legs about a body centerline axis.

In the exemplary embodiment shown, torsion spring 80 is coupled at a top end thereof to a shaft 82 and more particularly to a shaft slot. It is understood, however, that torsion spring 80 may of course be affixed and secured at its top end to shaft 82 by any suitable means including, but not limited to, the above-described shaft slot. Torsion spring 80 is further affixed at a bottom end 84 thereof to a bottom key or winding key 86. In keeping with the invention and the preferred embodiment shown and described, bottom key 86 freely rotates about a center axis of shaft 82 and functions to wind or "pre-load" torque onto torsion spring 80 prior to insertion into mounting rod 54 (and wound barrier screen 58) as will be described in further detail below. There is also provided a top key 88 positioned at and affixed to the top end of shaft 82. Like bottom key 86, top key 88 freely rotates about shaft 82, and more particularly, about the top end of shaft 82. Top key 88 is secured from removal from shaft 82 by a roll pin or other suitable retention member received within corresponding apertures of shaft 82 and top key 88. Again, it is understood that any suitable means may be used to secure top key 88 from removal. Notably, top key 88 is not affixed to torsion spring 80. Rather, top key 88 includes an annular notch that functions to guide the assembly (torsion spring 80 and shaft 82) into mounting rod 54. More specifically, a concave portion of a top key annular notch is received by a convex portion of a corresponding mounting rod annular notch, as will be described in further detail below.

Still referring to FIG. 5, the exemplary, but not required, embodiment shown and described includes top and bottom caps 90 and 92, respectively, removably affixable to housing 34. Again, the foregoing may comprise any suitable material including plastic, molded unitary aluminum, cast aluminum, extruded aluminum, and the like. In the preferred embodiment shown, top and bottom caps 90 and 92, also called top and bottom base caps, preferably, but not necessarily comprise cast aluminum, and housing 34 preferably, but not necessarily, comprises extruded aluminum. Bottom base cap 92 is affixed to shaft 82 in any suitable manner, including, for example by receiving shaft 82 within a receiving notch, aperture, or extension portion affixed to or molded within bottom cap 92 and securing the same with a roll pin or other suitable retention member so that shaft 82 is secured and oriented so it can't move. Once secured, bottom base cap 92 will rotate with shaft 82. Accordingly, once torsion spring 80 (affixed to shaft 82) is preloaded with torque to store mechanical energy, bottom cap 92 must be secured in place to prevent release of such energy. Housing 34 further defines an internal cavity and includes an elongate vertically disposed opening 94 or slot for receiving and extending barrier screen 58 through the housing 34 once assembled. As illustrated, in this preferred embodiment housing 34 is substantially rounded extending contiguously about a radius of three hundred and sixty degrees. It is understood, however, that any suitable shape, configuration, and/or orientation, including one or more additional sidewalls of varying shape, may be utilized without departing from the spirit, scope, and functionality of the disclosed invention.

As discussed in substantial more detail in co-pending patent application Serial Nos. 15/083,757, 15/201,665, and 15/380,332 filed Mar. 29, 2016, Jul. 5, 2016, and Dec. 15, 2016, respectively, the disclosures of which are incorporated herein by reference, the steps for preloading spring 80 with suitable torque are described. Accordingly, spring tension is first applied by rotating or winding base key (winding key) 86. While holding base cap 92 securely in place (as it is affixed to shaft 82), the entire assembly is inserted into mounting rod 54 using top key 88 and more particularly a top key notch as a guide for receipt by a corresponding annular notch and more particularly a convex portion thereof. Winding key 86 is thereafter secured in place similarly by mating adjacent ridges 96 with the same convex portion of the annular notch. Thereafter, bottom cap 92 is secured to bottom end 36 of housing 34 using any suitable fastener or fasteners such as screws 102 or the like. Top cap 90 is similarly secured to top end 40 of housing 34 in like manner. Top cap 90 includes a guide similarly having an annular notch. The guide functions to freely rotate within top cap 90. Specifically, the annular notch receives and mates with a corresponding mounting rod notch and more specifically a convex portion thereof. Accordingly, mounting rod 54 may freely rotate within housing 34 about top and bottom caps 90 and 92, respectively. More specifically, top end of mounting rod 54 rotates about a guide and bottom end 84 of mounting rod 54 rotates about bottom key 86 with preloaded torque applied thereto.

Still referring to FIG. 5, in a preferred embodiment, bottom winding key 86 may further include a guide member 100 comprising a separate component that may be coupled by any suitable means to a bottom surface of bottom winding key 86 or a top surface or lip of bottom winding key 86. In the latter case, guide member 100 may include one or more apertures or cut out portions as necessary to slide or otherwise fit over shaft 82 and torsion spring 80. Alternatively, guide member 100 may be integrally formed with bottom winding key 86 as shown in FIG. 5. Guide member 100 may comprise any suitable and preferably substantially rigid material including, but not limited to plastic, and is preferably, but not necessarily disk-shaped. It is understood, however, that any suitable size or shape may be utilized provided the objectives below are achieved. Guide member 100 may also be affixed to bottom key 86 in any suitable manner including, but not limited to, adhesive, screws or bolts, or other fastener or fastening means, or may be integrally molded therewith. In keeping with the invention, guide member 100 includes a surface portion having a sufficient diameter and oriented substantially perpendicular or normal to the flexible screen 58 to guide and promote substantially smooth extension and retraction of the screen 58 (i.e. inhibit binding or "bunching up") thus permitting the use of flexible screens comprising a greater array of materials and textures including those having a more "tacky" or "rubbery" composition, texture or feel. Again, substantial additional detail illustrating the foregoing is provided in co-pending patent application Ser. Nos. 15/083,757, 15/201,665, and 15/380,322 filed Mar. 29, 2016, Jul. 5, 2016, and Dec. 15, 2016, the disclosures of which are incorporated herein by reference.

In further preferred, but not required embodiment, flexible screen 58 may be cut tapered in height from the leading edge 66 to the trailing edge 56 thereof, so as to further assist in promoting the smooth retraction and extension of flexible screen 58. In such case, leading edge 66 may have a height that is greater than the height of the trailing edge 38 with the above-referenced tapering there between preferably, but not necessarily, in equal amounts at both the top and bottom portions of the trailing edge 56. The specific tapering, amount, and location thereof will depend in large part on the relative heights of the respective leading and trailing edges, the length or span of the flexible screen 58, the selected screen material, materials or composite construction, the corresponding modulus of elasticity of the foregoing, the resulting flexibility or "pliability" thereof, as well as the specific application. By way of example, but not limitation, leading edge 66 may have an exemplary height of 40 inches, the flexible screen may have a length or span of 6 feet, and the trailing edge 56 may be tapered equally a half inch at both the top and bottom portions thereof defining a trailing edge height of 39 inches. Of course, greater or less tapering as well as different tapering locations (including at the leading edge 66, the trailing edge 56, or both edges) and patterns may be employed to achieve different results and will provide different corresponding appearances of the flexible screen 58 upon being installed and extended. The above referenced tapering amounts and location are provided as exemplary of a preferred embodiment only wherein minimal tapering has been provided to achieve the objective of inhibiting binding or bunching up of the gate upon retraction and/or extension without substantially altering the appearance of the flexible screen 58 once extended (i.e. to appear upon casual inspection to have a uniform or near uniform height across the length or span of screen 58 once extended). Different tapering amounts and locations are thus anticipated depending on the application and desired performance (required flexibility or alternatively the lack of rigidity) and appearance of screen 58.

As those skilled in the art will recognize, and as referenced above, the rigidity of the material of screen 58 may more properly be referred to as its elastic modulus also known as its modulus of elasticity. Practically speaking, elastic modulus is not the same as stiffness. Elastic modulus is a property of the constituent material; stiffness is a property of a structure. Accordingly, modulus of elasticity is an intrinsic property of the material, whereas stiffness is an extrinsic property of a body dependent on the material and the shape of the boundary conditions. Modulus of elasticity is thus a prime property to be considered when selecting the above referenced screen material to achieve the desired stiffness of the resulting screen. In short, the modulus of elasticity must be sufficiently low to provide the required flexibility yet sufficiently high to inhibit or obviate undesirable binding or "bunching up" of the screen that might otherwise result particularly during retraction. More specifically, and in keeping with the invention herein, the modulus of elasticity of the screen material or materials must be sufficiently high such that the screen has sufficient stiffness to inhibit sagging or bowing of the same upon extension thus promoting the smooth retraction thereof by conversely obviating potential binding or bunching up of the screen which might otherwise result during retraction.

In further keeping with the invention, a variety of spacers may also be provided to reduce friction between guide member 100 and bottom cap 92. More specifically, such spacers may be provided to reduce friction between a bottom surface of guide member 100 and top surface of bottom cap 90. The use, design and placement of such spacers is again discussed in substantial more detail co-pending patent application Ser. Nos. 15/083,757, 15/201,665, and 15/380,322 filed Mar. 29, 2016, Jul. 5, 2016, and Dec. 15, 2016, the disclosures of which are incorporated herein by reference. Accordingly, a variety of spacers may be provided to reduce or eliminate such friction. Such spacers may comprise an additional disk having any suitable composition, rigidity, orientation, and dimension and may also comprise one or more raised portions such as buttons, nubs, ridges, or the like, coupled to or formed integral with either or both of the relative contacting surfaces.

In yet a further preferred embodiment provided to achieve the desired performance above, one or more support members may also be coupled to screen 58 at suitable locations to enhance the stiffness/rigidity of the screen 58, particularly, but not necessarily, limited to the vertical direction, beyond that of the elastic modulus of the selected screen material. By way of example, but not limitation, one or more flexible battens or the like comprising fiberglass, plastic, rubber, wire, or any suitable material or composition, including any combination of the foregoing, may be coupled to screen 58, again preferably, but not necessarily in the vertical direction, including for example, but not limitation, by insertion into one or more predefined receiving receptacles such as batten pockets commonly used in sails. The foregoing battens may be coupled or placed at any suitable location and orientation including along any portion or the entire span of the top and/or bottom edges and/or the leading or trailing edges of screen 58 or anywhere there between, including extending inward at any angle from any such edge.

Figure 6A:
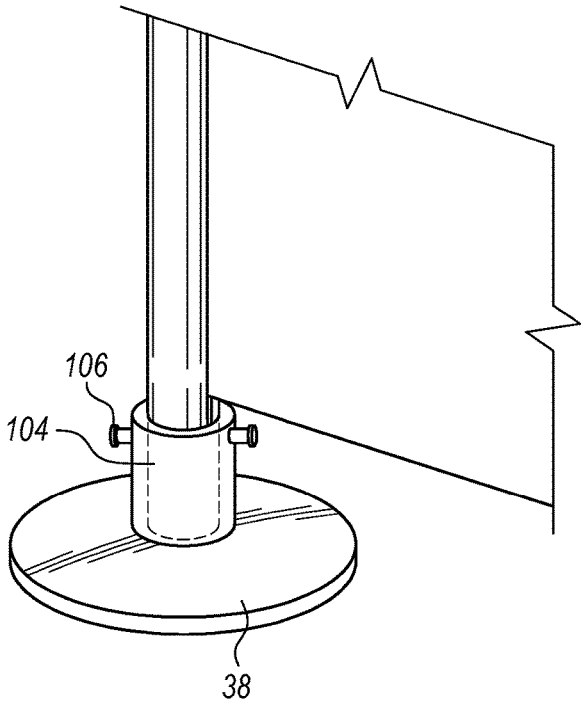
FIG. 6A is a perspective diagram of a first preferred, but not required embodiment, for removably affixing the housing of the retractable barrier assembly of the present invention to a suitable retaining member shown as a substantially upright socket integrally formed with a weighted base.
Figure 6B:
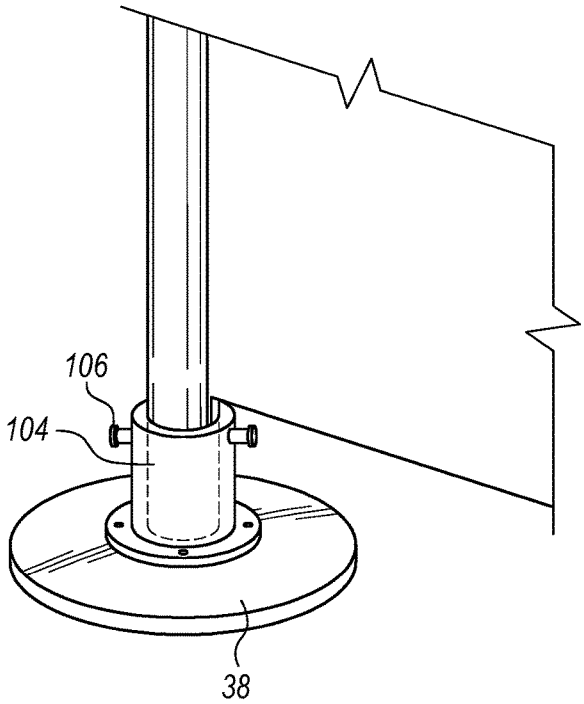
FIG. 6B is a perspective diagram of a second preferred, but not required embodiment, for removably affixing the housing of the retractable barrier system of the present invention to a suitable retaining member shown as a substantially upright socket removably affixable to a weighted base.
Figure 6C:
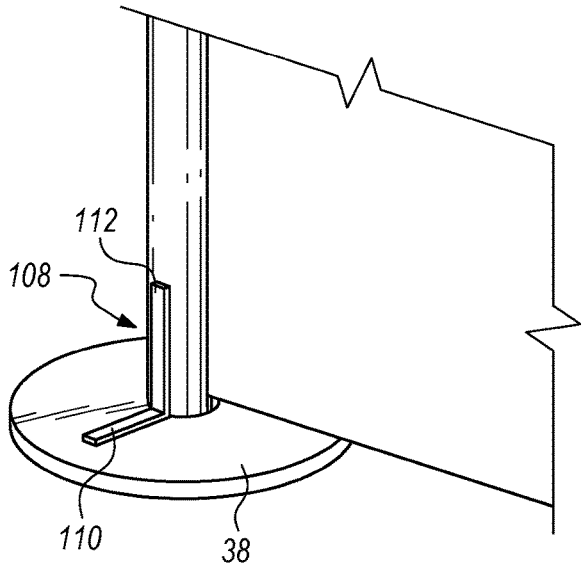
FIG. 6C is a perspective diagram of a third preferred, but not required embodiment, for removably affixing the housing of the retractable barrier system of the present invention to a suitable retaining member shown as an angle bracket removable affixable to the housing and a weighted base.
Figure 7:
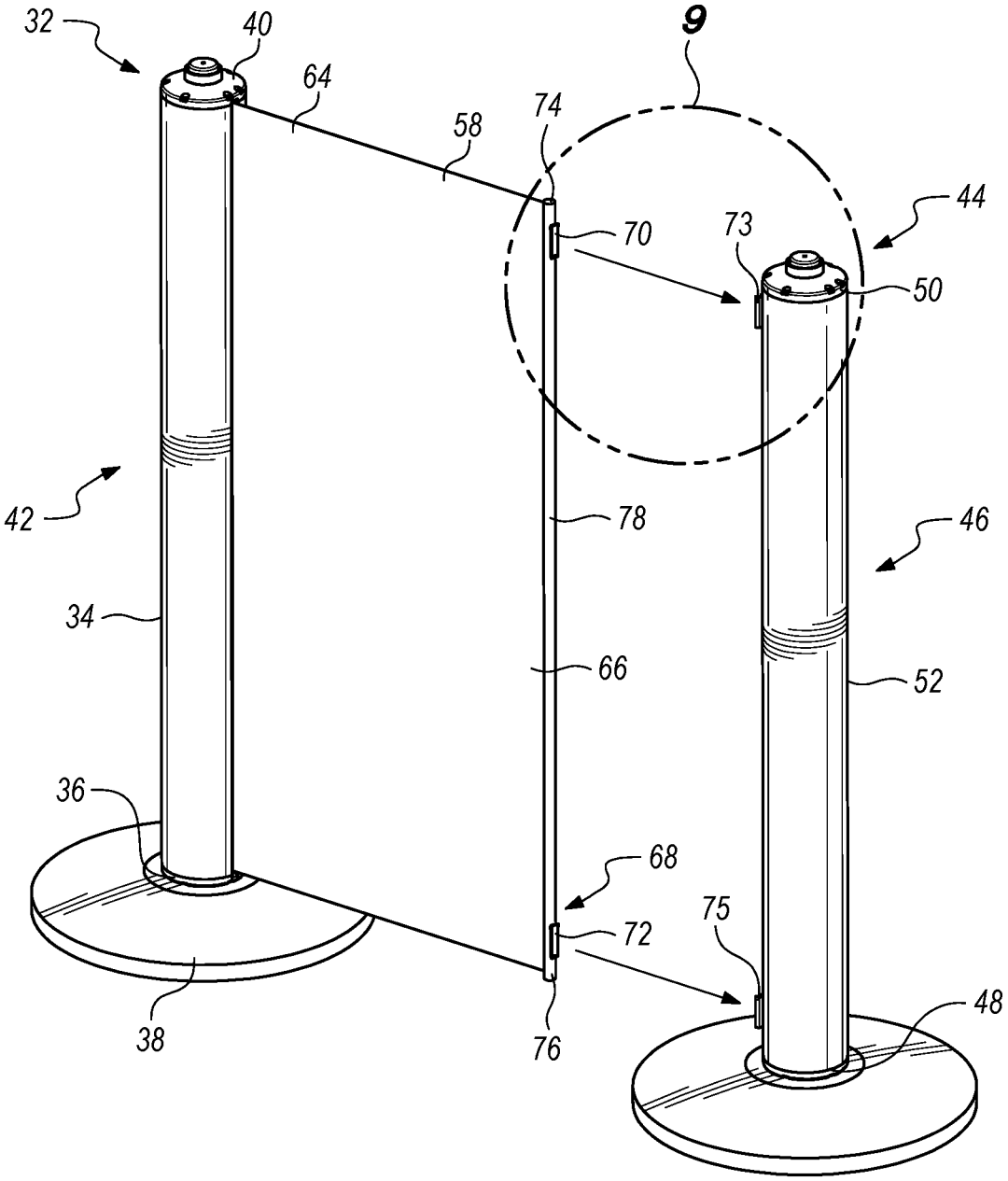
FIG. 7 is a perspective diagram of the improved retractable gate assembly of the present invention for guiding and routing persons along designated pathways defined by interconnecting the retractable gate assembly with one or more additional such assemblies, and inhibiting ingress to and egress from such pathways, shown with its retractable screen partially extended for connection to an additional such assembly, and further illustrating one preferred, but not required connection assembly.
Figure 8:
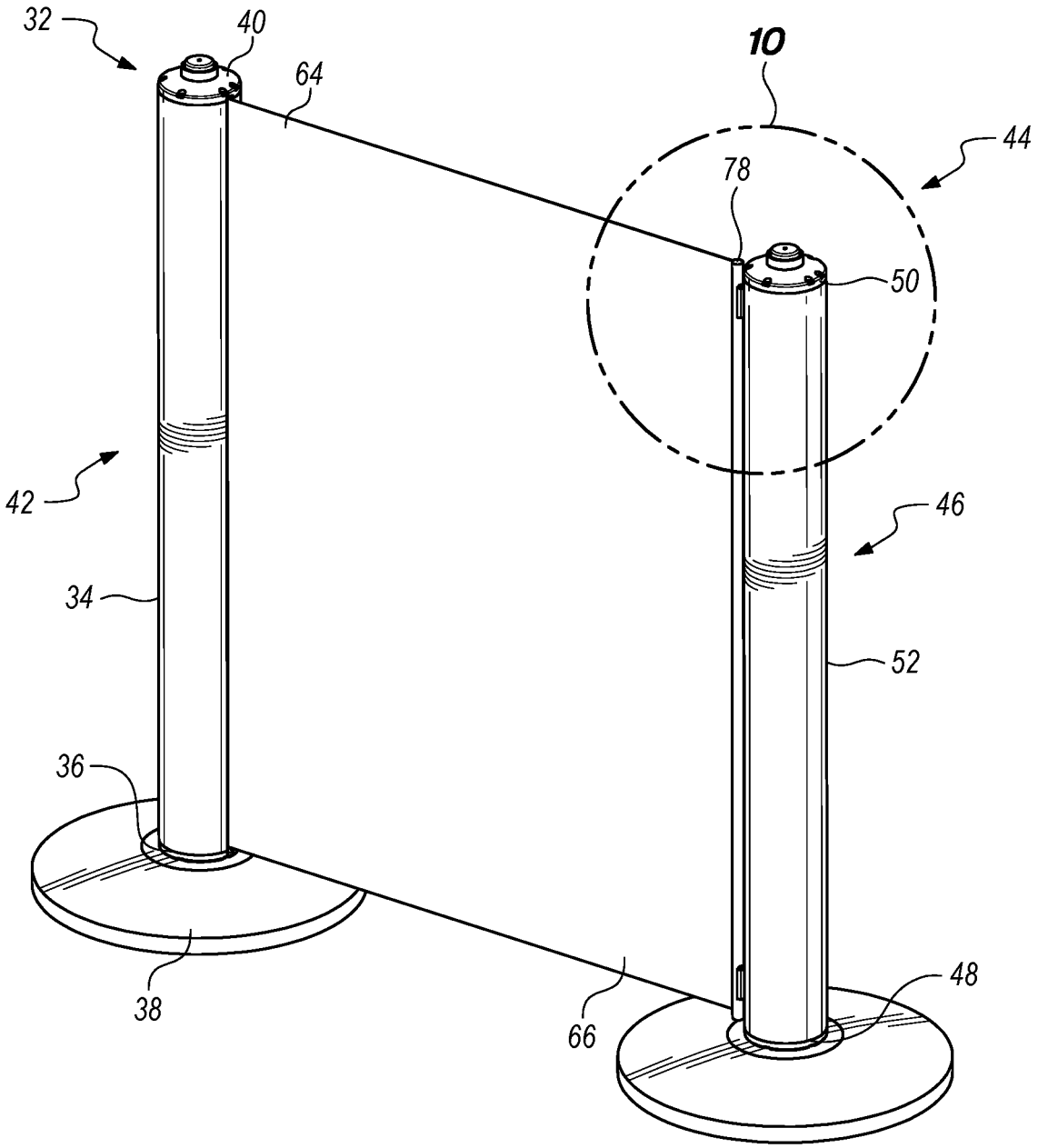
FIG. 8 is a perspective diagram of the improved retractable gate assembly of the present invention for guiding and routing persons along designated pathways defined by interconnecting the retractable gate assembly with one or more additional such assemblies, and inhibiting ingress to and egress from such pathways, shown with its retractable screen fully extended and connected to an additional such assembly, and further illustrating one preferred, but not required connection assembly.
Figure 9:
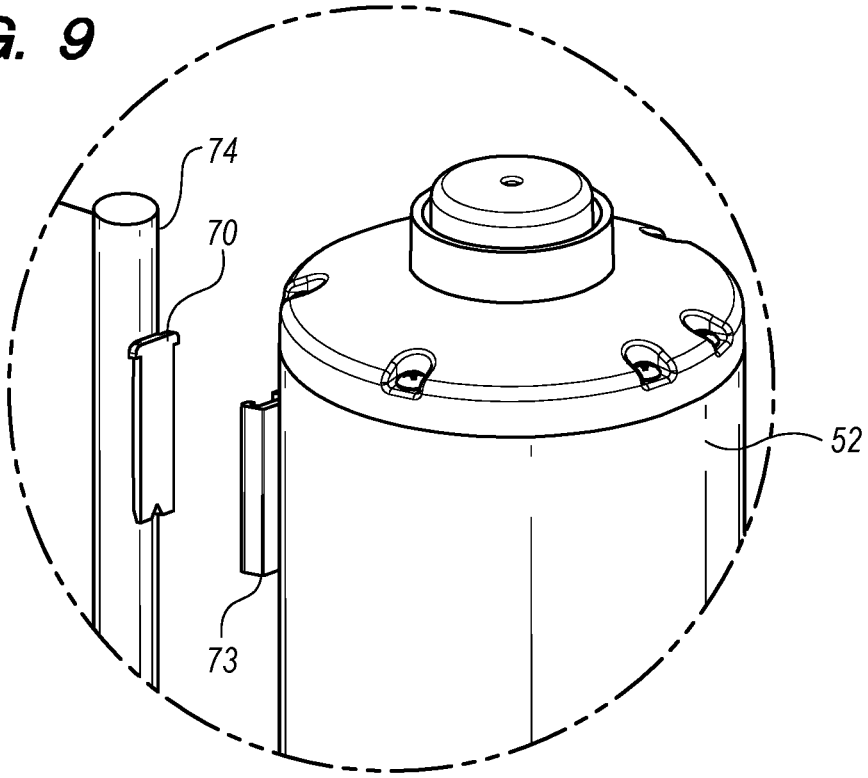
FIG. 9 is an enlarged perspective view of the detail of FIG. 7.
Figure 10:
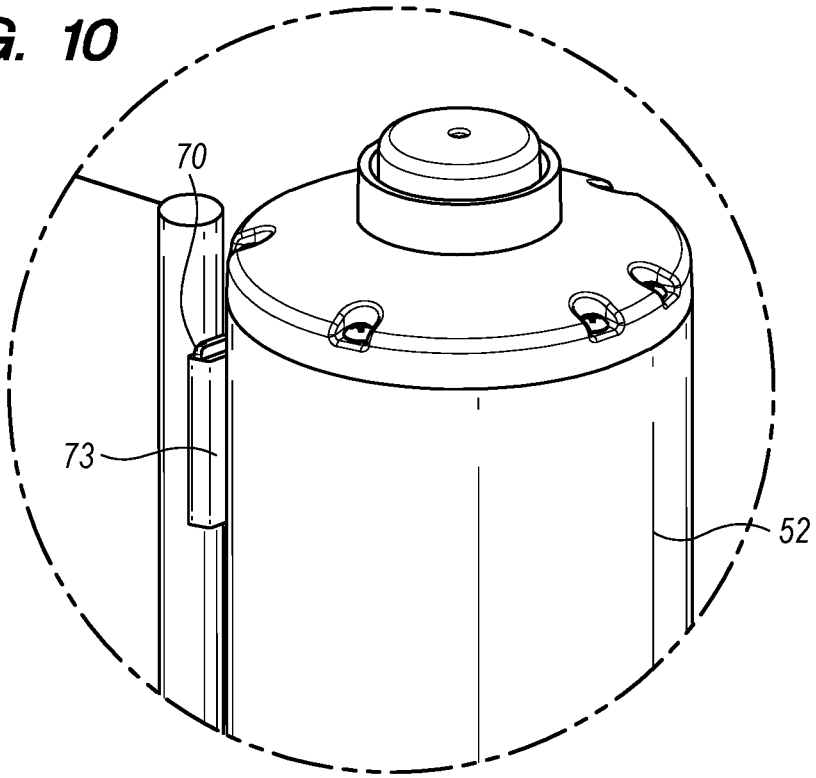
FIG. 10 is an enlarged perspective view of the detail of FIG. 8.

As shown and described above, housing 34 of the retractable barrier assembly 32 of the present invention may be removably affixable to a retaining member including a base 38, in any variety of suitable ways. In one preferred, but not required embodiment, bottom cap 92 of housing 34 may secured directly to base 38 by one or more annular spaced fasteners such as bolts or screws. Alternatively, a bolt 103 may be provided to be received within a threaded channel of bottom cap 92. In an alternative preferred, but not required, embodiment shown in FIG. 6A, an upright socket 104 is integrally molded with retaining member (weighted base) 38 for receiving and securing housing 34 with corresponding fasteners such as set screws 106. In yet a further preferred, but not required embodiment shown in FIG. 6B, upright socket 104 is removably affixable to retaining member 38 and is similarly designed to receive and secure housing 34 with corresponding fasteners such as set screws 106. Yet a further preferred, but not required embodiment shown in FIG. 6C illustrates an angle bracket 108 having a first arm 110 removably affixable to the base 38, and a second arm 112 extending from and oriented substantially perpendicular to the first arm 110 that is removably affixable to the housing 34, in each case by suitable fastening means such as set screws, bolts, interlocking members, or the like.

While embodiments of the invention have been illustrated and described, it is not intended that these embodiments illustrate and describe all possible forms of the invention. Rather, the words used in the specification are words of description rather than limitation, and it is understood that various changes may be made, and equivalent structures, features, and functions may be provided, without departing from the spirit and scope of the invention.

What is claimed is:

1. A non-anchored, self-supporting screen assembly for selective placement by a user on a walking surface, comprising:

a base member;

a housing having a first end, a second opposing end, and a sidewall extending therebetween and having an elongate opening;

a base coupler affixed to the base member and the housing, whereby the housing is independently supported and disposed in an upright position substantially normal to the walking surface during use;

a rotatable rod disposed within the housing;

a flexible screen having a trailing edge coupled to the rotatable rod, a leading edge, and a top edge extending between the trailing edge and the leading edge;

an edge coupler attached to the leading edge to couple the leading edge to an external attachment point upon extension of the screen through the elongate opening and decouple the leading edge from the external attachment point upon retraction; and a spring coupled to the rotatable rod to exert a force in a direction opposite a direction of extension of the flexible screen.

2. The non-anchored, self-supporting screen assembly of claim 1, further comprising a receiving member for receiving and coupling the assembly to a leading edge of a flexible screen of an adjacent non-anchored, self-supporting screen assembly.

3. A screen system for selective placement by a user on a walking surface, comprising:

a plurality of non-anchored, self-supporting screen assemblies, each assembly comprising a base member;

a housing having a first end, a second opposing end, and a sidewall extending therebetween and having an elongate opening;

a base coupler affixed to the base member and the housing, whereby the housing is independently supported and disposed in an upright position substantially normal to the walking surface during use;

a rotatable rod disposed within the housing;

a flexible screen having a trailing edge coupled to the rotatable rod, a leading edge, and a top edge extending between the trailing edge and the leading edge;

a receiving member;

an edge coupler attached to the leading edge to couple the flexible screen leading edge to the receiving member of an adjacent non-anchored, self-supporting screen assembly when the flexible screen leading edge is extended through the elongate opening and decouple the leading edge from the receiving member of the adjacent non-anchored, self-supporting screen assembly when the flexible screen is retracted; and a spring coupled to the rotatable rod to exert a force in a direction opposite a direction the flexible screen is extended through the elongate opening of the sidewall.

4. A non-anchored, self-supporting screen assembly for selective placement by a user on a walking surface, comprising:

a housing having a first end, a second opposing end, and a sidewall extending therebetween and having an elongate opening;

a base member supporting and disposing the housing in an upright position substantially normal to the walking surface during use;

a rotatable rod disposed within the housing;

a flexible screen having a trailing edge coupled to the rotatable rod, a leading edge, and a top edge extending between the trailing edge and the leading edge;

an edge coupler attached to the leading edge to couple the leading edge to an external attachment point upon extension of the screen through the elongate opening and decouple the leading edge from the external attachment point upon retraction; and a spring coupled to the rotatable rod to exert a force in a direction opposite a direction of extension of the flexible screen.

5. The non-anchored, self-supporting screen assembly of claim 4, further comprising a receiving member for receiving and coupling the assembly to a flexible screen of an adjacent non-anchored, self-supporting screen assembly.

6. A screen system for selective placement by a user on a walking surface, comprising:

a plurality of non-anchored, self-supporting screen assemblies, each assembly comprising:

a housing having a first end, a second opposing end, and a sidewall extending therebetween and having an elongate opening;

a base member supporting and disposing the housing in an upright position substantially normal to the walking surface during use;

a rotatable rod disposed within the housing;

a flexible screen having a trailing edge coupled to the rotatable rod, a leading edge, and a top edge extending between the trailing edge and the leading edge;

a spring coupled to the rotatable rod to exert a force in a direction opposite a direction the flexible screen is extended through the elongate opening of the sidewall; and a receiving member to receive and couple to the flexible screen of an adjacent non-anchored, self-supporting screen assembly when the flexible screen of the adjacent screen assembly is extended and decouple therefrom when the flexible screen of the adjacent screen assembly is retracted.

* * * * *